US010633220B2

(12) United States Patent
Van Deurse et al.

(10) Patent No.: US 10,633,220 B2
(45) Date of Patent: Apr. 28, 2020

(54) MONITORING SYSTEM FOR PNEUMATIC CORE SHAFTS AND SHAFT ADAPTERS

(71) Applicants: Michael Van Deurse, Norton, MA (US); Greg Sandford, Brockton, MA (US)

(72) Inventors: Michael Van Deurse, Norton, MA (US); Greg Sandford, Brockton, MA (US)

( * ) Notice: Subject to any disclaimer, the term of this patent is extended or adjusted under 35 U.S.C. 154(b) by 167 days.

(21) Appl. No.: 16/039,061

(22) Filed: Jul. 18, 2018

(65) Prior Publication Data

US 2019/0023525 A1 Jan. 24, 2019

Related U.S. Application Data

(60) Provisional application No. 62/534,744, filed on Jul. 20, 2017.

(51) Int. Cl.
*B65H 75/44* (2006.01)
*B65H 75/24* (2006.01)

(52) U.S. Cl.
CPC ..... *B65H 75/4484* (2013.01); *B65H 75/242* (2013.01); *B65H 75/243* (2013.01); *B65H 2553/27* (2013.01); *B65H 2553/822* (2013.01)

(58) Field of Classification Search
CPC ..... B65H 75/4484; B65H 75/243; B65H 75/242; B65H 2553/27; B65H 2553/822
See application file for complete search history.

(56) References Cited

U.S. PATENT DOCUMENTS

| | | | | |
|---|---|---|---|---|
| 1,226,984 | A | 5/1917 | Muskett | |
| 1,277,995 | A | 9/1918 | Muskett | |
| 2,289,453 | A | 7/1942 | Randall | |
| 3,391,878 | A * | 7/1968 | Naccara | B65H 75/243 242/571.1 |
| 3,834,257 | A * | 9/1974 | Ganser | B29C 53/78 82/169 |
| 4,060,445 | A * | 11/1977 | Houck | B29D 30/247 156/414 |
| 4,135,677 | A | 1/1979 | Warczak | |
| 4,436,252 | A * | 3/1984 | Burkle | B23B 31/305 242/571.1 |
| 4,712,472 | A | 12/1987 | Meisen et al. | |
| 5,372,331 | A * | 12/1994 | Miller | B65H 75/243 242/571.1 |
| 6,182,977 | B1 * | 2/2001 | Weller | B25B 5/065 242/571.1 |
| 6,578,483 | B2 | 6/2003 | Compera et al. | |
| 6,862,989 | B2 | 3/2005 | Belanger et al. | |
| 6,905,119 | B2 | 6/2005 | Guddanti et al. | |
| 7,392,715 | B2 | 7/2008 | Moore et al. | |
| 7,823,825 | B2 * | 11/2010 | Genta | B41J 11/001 242/573 |

(Continued)

FOREIGN PATENT DOCUMENTS

DE 102012008184 B4 4/2012

*Primary Examiner* — William A. Rivera
(74) *Attorney, Agent, or Firm* — John P. McGonagle

(57) ABSTRACT

A monitoring system for pneumatic shafts and pneumatic shaft adapters. A sensor assembly is physically joined in operative engagement with the bladders of pneumatic shafts and adapters. Sensed data is wirelessly transmitted to a remote receiver for processing and display.

23 Claims, 15 Drawing Sheets

(56) References Cited

U.S. PATENT DOCUMENTS

| | | | | |
|---|---|---|---|---|
| 8,286,904 | B2 * | 10/2012 | Pellengo Gatti ... | B65H 19/2276 242/532.2 |
| 8,523,099 | B2 | 9/2013 | Kipping et al. | |
| 9,540,769 | B2 | 1/2017 | Figiel | |
| 2009/0211353 | A1 | 8/2009 | Gao et al. | |
| 2011/0012479 | A1 | 1/2011 | Nakamura et al. | |

* cited by examiner

MONITORING SYSTEM FOR PNEUMATIC CORE SHAFTS AND SHAFT ADAPTERS

CROSS-REFERENCE TO RELATED APPLICATIONS

Applicants claim the priority benefits of U.S. Provisional Application No. 62/534,744, filed Jul. 2, 2017.

BACKGROUND OF THE INVENTION

This invention relates to pneumatic core shafts and pneumatic shaft adapters, and in particular, to a system for directly monitoring operating criteria for pneumatic core shafts and pneumatic shaft adapters.

Pneumatic core shafts are expanding shafts for gripping and holding a core of a wound material roll. The shaft transmits torque to the roll of material from a motor, clutch or brake thereby winding, unwinding or stopping rotation of the core. The core shaft then engages and is driven by machine. The wound material can be any flexible web, e.g., paper, film, foil, nonwovens, and the like.

Pneumatic core shafts generally have a central air bladder or multiple air bladders within a bearing tube. Inflating the air bladder or bladders force attached lugs through openings in the bearing tube. A typical bladder will be pressurized to 80 psi. The lugs grip and hold the internal surface of the core of a web material roll. Lugs may have different shapes, such as ovals, buttons, strips, leafs, and spirals, Some pneumatic core shafts have multiple bladders such as with strip and leaf lugs, Pneumatic shaft adapters typically enable the use of small diameter shafts with a larger diameter cores. One type of pneumatic shaft adapter has an external bladder, wherein the bladder expands to engage directly with the interior of a core. This same technology would be used on shaft adapters with a hollow central bore which slide over the outer diameter of another shaft to adapt from a smaller core size to a larger core size.

If air pressure in a core shaft or shaft adapter air bladder is lost during operation, the core can slip on the shaft or adapter, and torque is no longer transmitted from the motor, clutch or brake. This causes tension loss in the running web and results in process defects. Core slip can also damage the inside of the core so that a partially wound roll of material is no longer usable.

There is, therefore, a need to monitor air pressure in the shaft air bladder or pneumatic shaft adapter bladder to ensure no slipping is occurring. This is challenging due to the rotating nature of the shaft and core. Rotary unions are possible, but require complex pneumatic connections. There is also an advantage to automatically providing an alarm signal to a parent machine while running if a leak occurs. There is also an advantage to automatically providing a "ready to run" signal during air shaft or adapter inflation. With existing technologies, if an operator forgets to inflate, or only partially inflates, an unwind or rewind shaft, and then starts the machine, web material breaks are probable resulting in costly scrap as well as lost time to repair the operation. With larger shafts, the time to fill an air bladder to proper pressure may be up to ten minutes. An operator may believe a particular shaft or adapter is properly inflated, when it is actually underinflated. This leads to slippage and core damage.

Often times a slow leak in the bladder occurs before a large scale blow out. Detecting and alerting operators to a slow leak can prevent slippage and process mishaps. A slow leak is also indicative that maintenance needs to be performed on the shaft.

It is known to have variable air pressure inside a rewind shaft bladder. However, the air pressure sensing mechanisms is always located external to the shaft as part of the air supply line or integrated in an external air pressure transducer. These types of shafts are called "friction shafts" or "slip shafts" or "differential rewind shafts" and all require a constant air pressure connection be made through a rotary union to the shaft from a parent machine while the shaft is in operation.

SUMMARY OF THE INVENTION

The present invention overcomes the disadvantages of prior art pneumatic expanding shafts and shaft adapters with integrated sensors by providing wireless air pressure sensor technology to additional expanding shaft and shaft adapter designs. Firstly is to a multiple bladder shaft design where multiple bladders are connected by one air manifold. Secondly is an external bladder style shaft adapter which uses no separate clamping elements, i.e., the bladder makes direct contact with the core. Thirdly, in the case of single central shaft bladder designs, the sensor connects on an opposite journal side of the shaft to a secondary air manifold. The sensor is physically seated in a cavity formed in the bearing tube or adapter end cap or adapter flange ring. If the sensor cavity is located on the same journal as the cavity for the inflation valve, the total strength of the journal is reduced. It is, therefore, an advantage to having the sensor located on the opposite side journal. The sensor measures actual air pressure within the air bladder or air piston and transmits sensed measurements to a nearby receiver where the sensed data is passed to an appropriate processor. The invention sensor operates whether or not the shaft is turning. By seating the sensor within a cavity, the sensor is protected from the web core. The sensor cavity is preferably located near one or more shaft ends so that transmission is not interfered with by the core or web material wound on the core. The sensor is separate and independent from the bladder air supply line.

Current battery powered sensors provide limits on the rate of data transmitted as each transmission drains the battery further. Sensors in the present invention are optionally powered using battery-less energy harvesting methods providing transmission of more complete data with an improved sample rate for faster response times. Energy harvesting uses piezoelectric or similar technology which takes the mechanical rotational and vibrational energy of the shaft and converts it to low power electrical energy with enough power to energize the wireless sensor assembly. In applications that use batteries it is advantageous for the battery itself to be end-user replaceable so customers do not need to repeatedly purchase complete sensor assemblies and then repairing them with the shafts and control devices.

Factories with high quality control requirements use supervisor control and date acquisition (SCADA) technology or other industrial communications systems to monitor run parameters for all aspects of their machines. The invention sensor output can easily be incorporated into a factory's industrial communications system.

Some pneumatic bladders require certain operating temperature ranges to hold air pressure. There is also often a need to monitor shaft temperature and provide an alarm output if a maximum or minimum temperature has been exceeded. The invention sensor contains temperature sensing means as well as air pressure sensing means.

There is an advantage to actively monitoring a shaft rotation, i.e., when it is rotating or not rotating. Furthermore, multiple shafts are often used on one unwind/rewind of a web handling machine. There is an advantage to knowing the total run time on any given shaft for preventative maintenance purposes. There is also an advantage to quickly identifying which shaft(s) is (are) being run on a machine. Rotation of a pneumatic core shaft or adapter is measurable through the invention sensor by the addition of an accelerometer to the invention sensor.

The present invention is used with any pneumatic expanding shaft or pneumatic shaft adapter in which air pressure is used to create friction against the inside of a winding core for gripping, including but not limited to:

1. Central bladder type lug shafts,
2. Central bladder type button shafts,
3. Multiple-bladder type leaf shafts,
4. Multiple bladder external element type strip shafts and core adaptors,
5. Spiral external element type expanding shafts,
6. External bladder type shaft adapters,
7. Pneumatic-mechanical shafts, and
8. Shafts using mechanical type expansion and pneumatic type retraction.

The invention sensor has a plurality of sensor means and has the ability to transmit sensed data, including a sensor identification code. The invention sensor may also sense battery voltage level, air pressure, temperature and rotational acceleration.

The invention sensor is mounted below the outer diameter surface of the shaft or adapter in such a way that the sensor can transmit wireless signals and also avoid interference with sliding a winding core onto and off of the shaft when a web roll is being loaded or unloaded.

These together with other objects of the invention, along with various features of novelty which characterize the invention, are pointed out with particularity in the disclosure annexed hereto and forming a part of this disclosure. For a better understanding of the invention, its operating advantages and the specific objects attained by its uses, reference should be made to the accompanying drawings and descriptive matter in which there is illustrated a preferred embodiment of the invention.

DETAILED DESCRIPTION OF INVENTION

Figure 1:
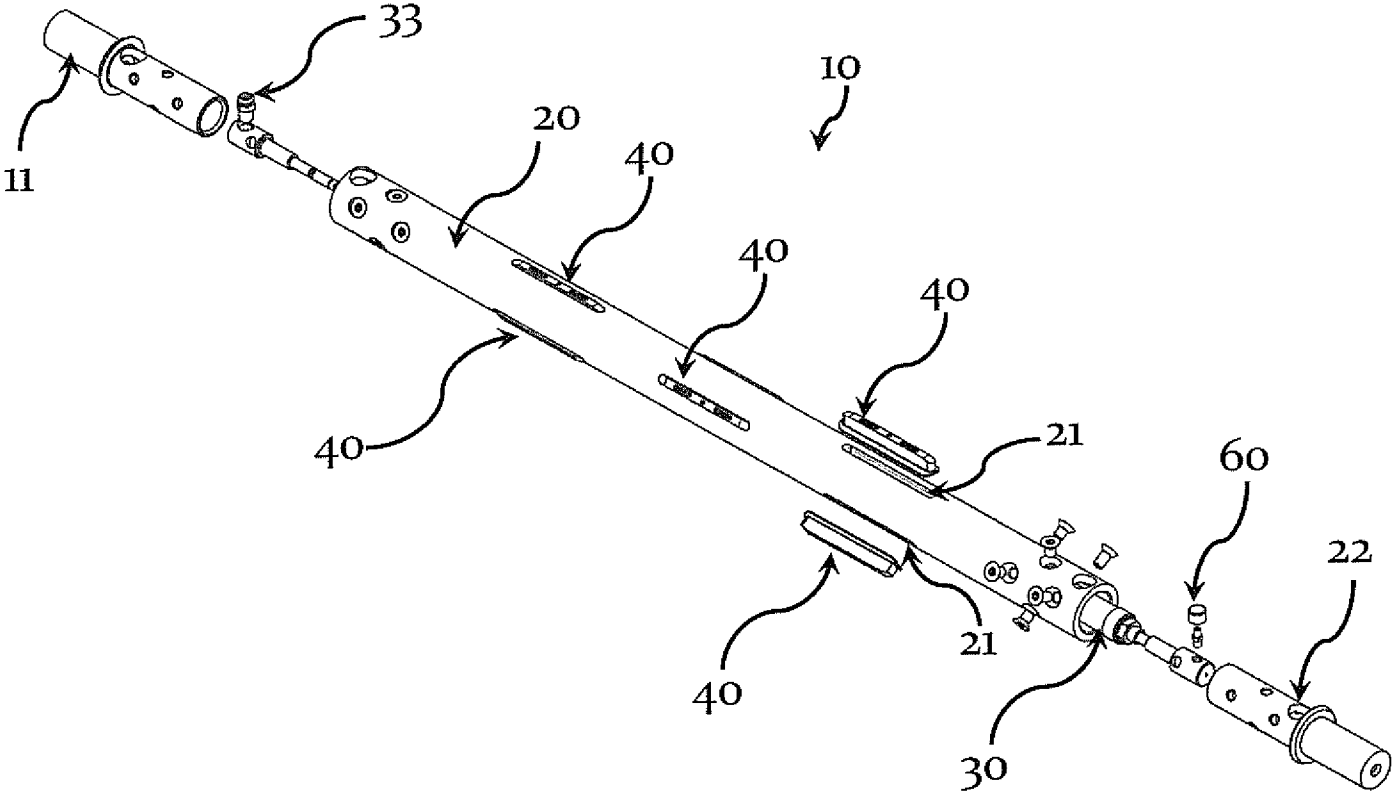
FIG. 1 is a view, partially exploded of a pneumatic core shaft with a single bladder.

Referring to the drawings in detail wherein like elements are indicated by like numerals there is shown a pneumatic expanding core shaft 10 comprised of a hollow, cylindrical bearing tube 20 with one or more air bladders 30 contained within. The air bladder 30 has a pneumatic inflation valve 33 near a bladder end for inserting or releasing air into the bladder. Each air bladder 30 has an exterior surface 31 driving one or more lugs 40 loosely held and protruding through lug apertures 21 in the bearing tube 20. The lugs 40 engage the core 51 of a roll 50 of wound web material 52. In some configurations, the air bladder itself can engage the core without use of a separate lug. The shaft 10 has two ends 11 which may be journaled into a machine, engaged with two safety chucks, or engaged by a cam-follower type bearing, or other drive coupling method. As is expounded further below, with shaft adapter configurations, there is a hollow central bore, wherein the adapter slides over a smaller diameter shaft 10.

Figure 2:
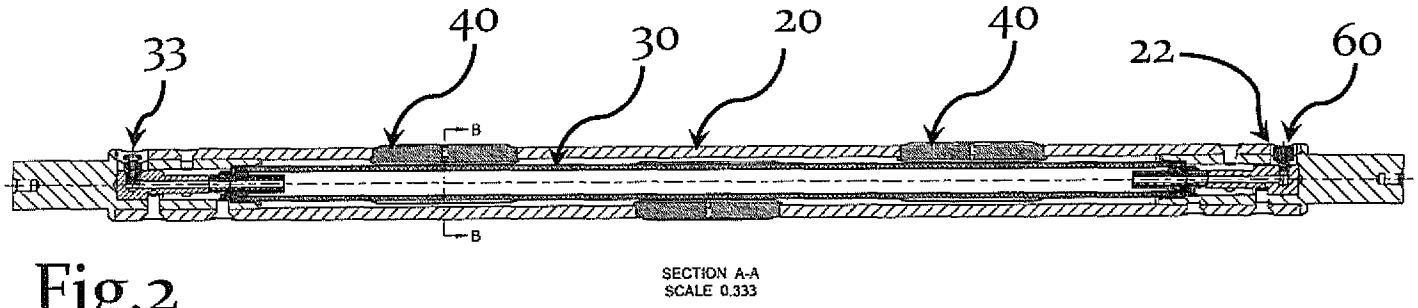
FIG. 2 is a cross-sectional view of the single bladder pneumatic core shaft along the shaft longitudinal axis.
Figure 3:
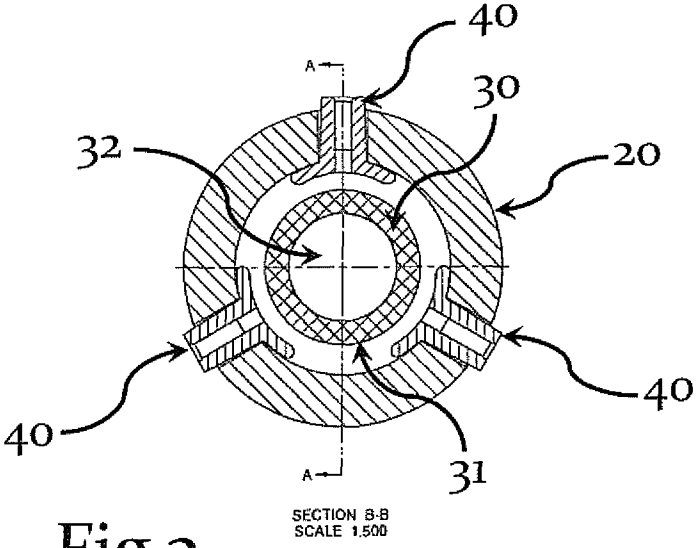
FIG. 3 is radial axis view of the shaft of FIG. 2 along the line B-B.
Figure 4A:
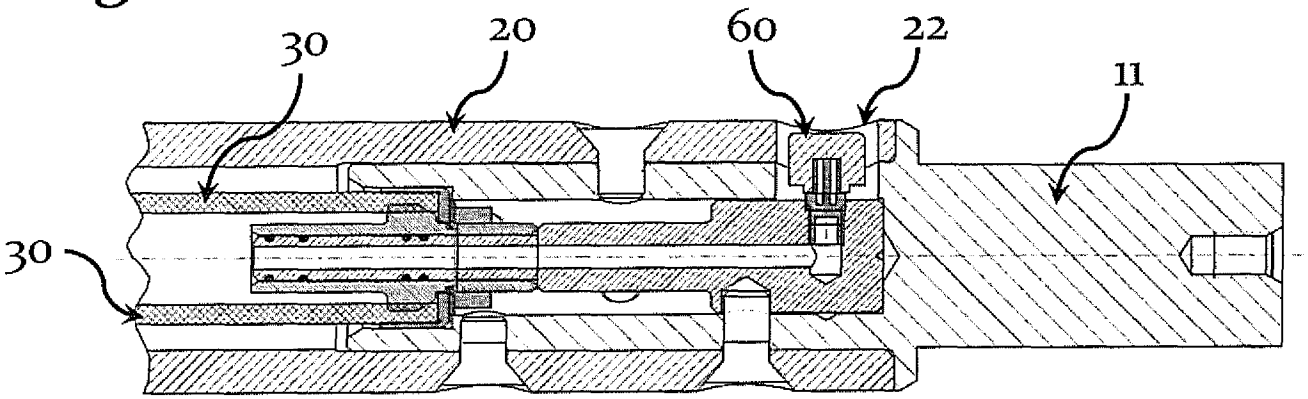
FIG. 4A is a close up view of the right section of the shaft shown in FIG. 2.
Figure 4B:
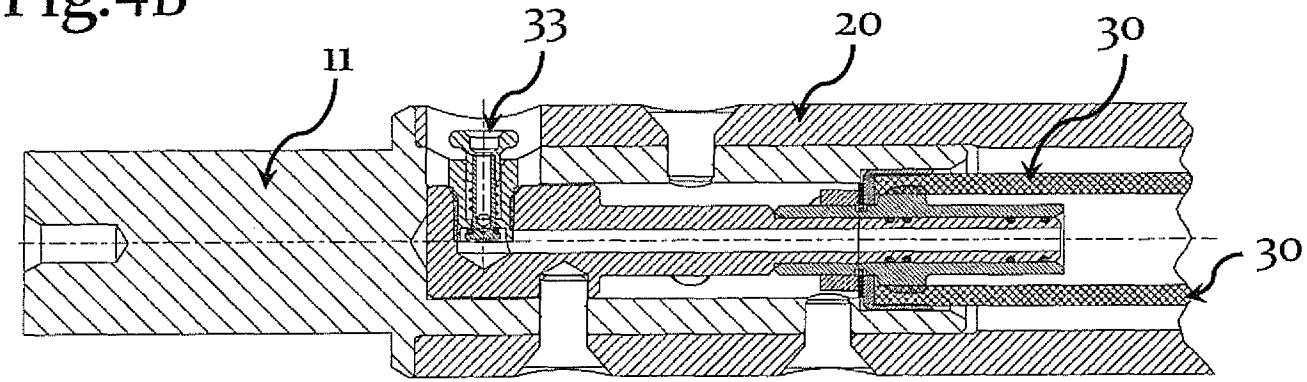
FIG. 4B is a close up view of the left section of the shaft shown in FIG. 2.
Figure 10:
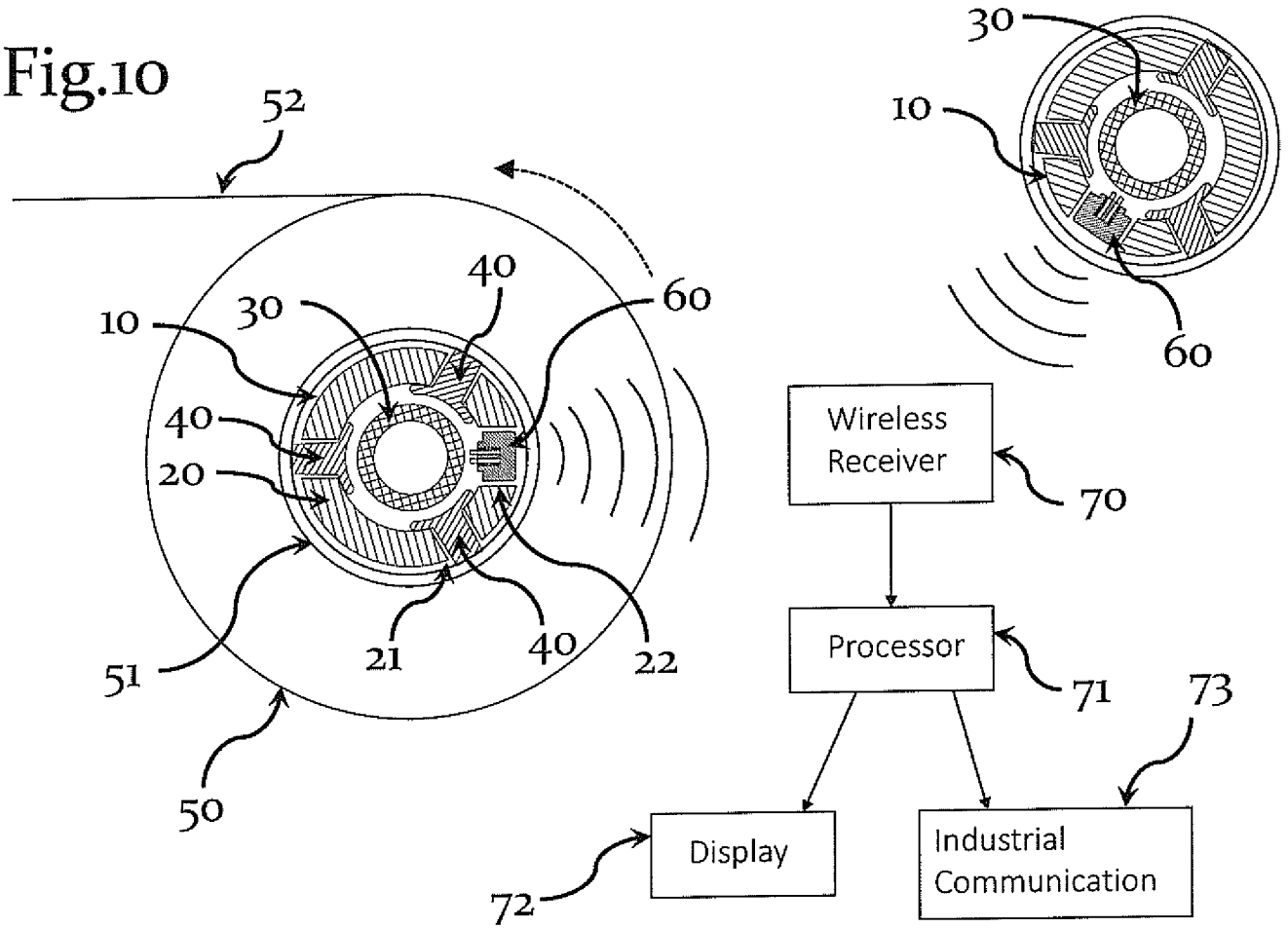
FIG. 10 is a diagrammic view, partly in section, of a two shaft process.
Figure 11:
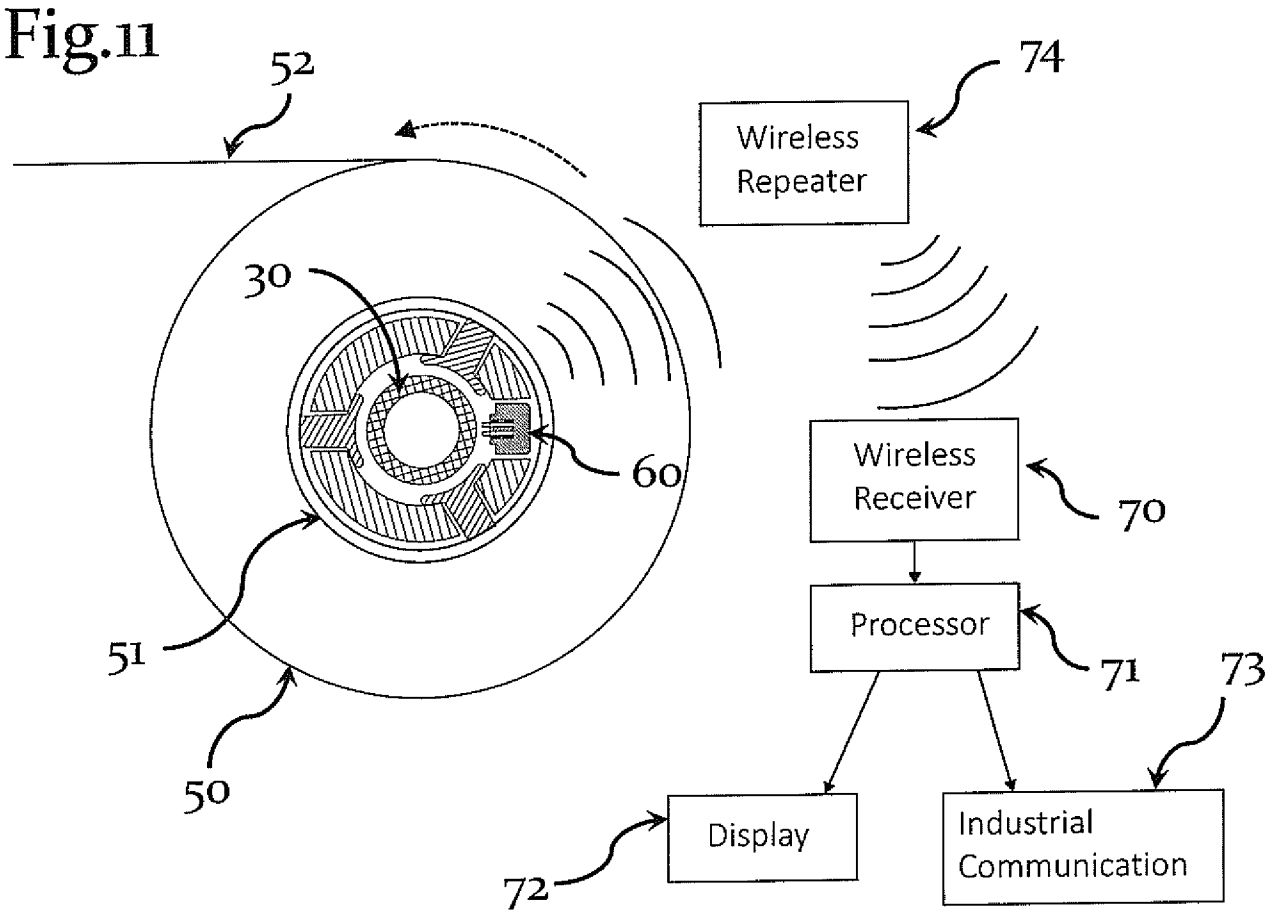
FIG. 11 is a diagrammic view, partly in section, of a single shaft process with a repeater.
Figure 18:
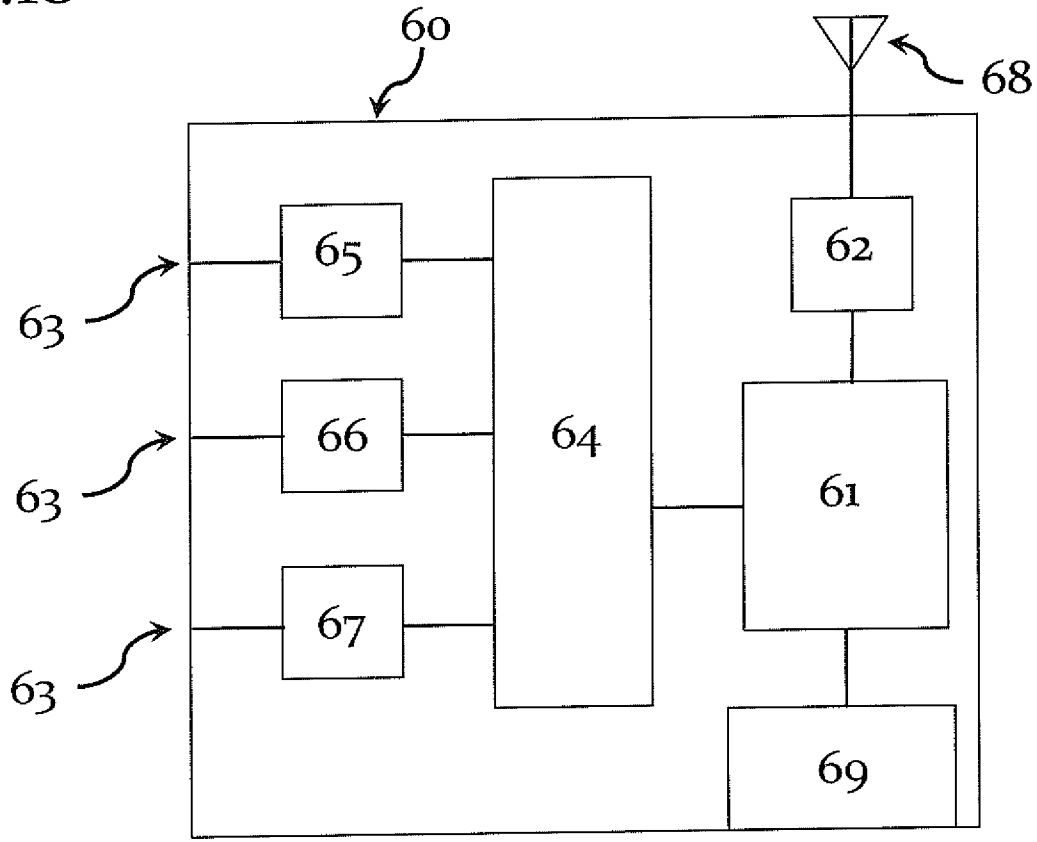
FIG. 18 is a schematic view of a sensor assembly.

Referring more particularly to FIGS. 1-4, 10-11 and 18, there is shown a pneumatic core shaft 10 with a single air bladder 30 contained within a cylindrical bearing tube 20. The shaft bearing tube 20 has a sensor aperture 22 formed therein providing an opening to the air bladder 30. A sensor assembly 60 is seated within the bearing tube sensor aperture 22 and joined in operative engagement with an air bladder interior 32. The sensor assembly 60 is generally positioned at a bladder end opposite to the inflation valve 33. Each sensor assembly 60 is comprised of one or more transducers 63, a sensor pre-processor 64, a microprocessor 61, a wireless transmitter 62 and antenna 68. Preferably, the transducers are comprised of an air pressure sensor 65, acceleration sensor 66 and temperature sensor 67. The sensor assembly may have a battery 69 to provide power or the sensor assembly may be powered through battery-less energy harvesting means. In either case, it would be desirable to also include power level sensing means within the sensor assembly.

The sensor assembly 60 senses performance factors such as air pressure, temperature, and shaft rotation. Sensed data is stored in the sensor pre-processor 64 and then passed to the microprocessor 61 for transmittal to an external receiver 70. The external receiver 70 passes the signal with the data to a processor 71 wherein the data is stripped from the signal and processed into desired formats. The processor 71 may then pass processed data to a display 72 and/or industrial communication system 73. The receiver 70, processor 71 and display 72 can all be integrated into an existing tablet or smart phone unit. Where the sensor assembly transmitted signal must transmit over a large area or is subject to interference from various sources, a repeater 74 would be positioned near to the sensor assembly to provide means for boosting power within the signal. The transmitted signal can be any wireless signal including, but not limited to, RF, Bluetooth, induction wireless, UWB, ZigBee, or other.

The processor and display functions may provide the following control and monitoring features:

1. Visual/audible/digital signal alarms when air bladder pressure is outside preprogrammed minimum and maximum limits;
2. Visual/audible/digital signal alarms when temperature is outside preprogrammed minimum and maximum limits;
3. Internal logic to determine when a shaft has been inflated.
4. Resettable counter for number of inflations for a specific shaft;
5. Timer to determine total time a shaft has been inflated;
6. Visual/audible/digital signal alarm to indicate a preset inflation value has been reached;
7. Operating lock until a preset inflation has been reached;
8. Visual/audible/digital signal alarm indicating a bladder slow leak;
9. Visual/audible/digital signal alarm output indicating a low battery level for sensors with batteries;
10. Visual/audible/digital indicators when shaft starts and stops rotating;
11. Counter/timer determining number and/or time shaft has been rotating;
12. Visual/audible/digital indicator of shaft RPM; and
13. Visual/audible/digital signal alarms when shaft RPM is outside programmed ranges.

Figure 5:
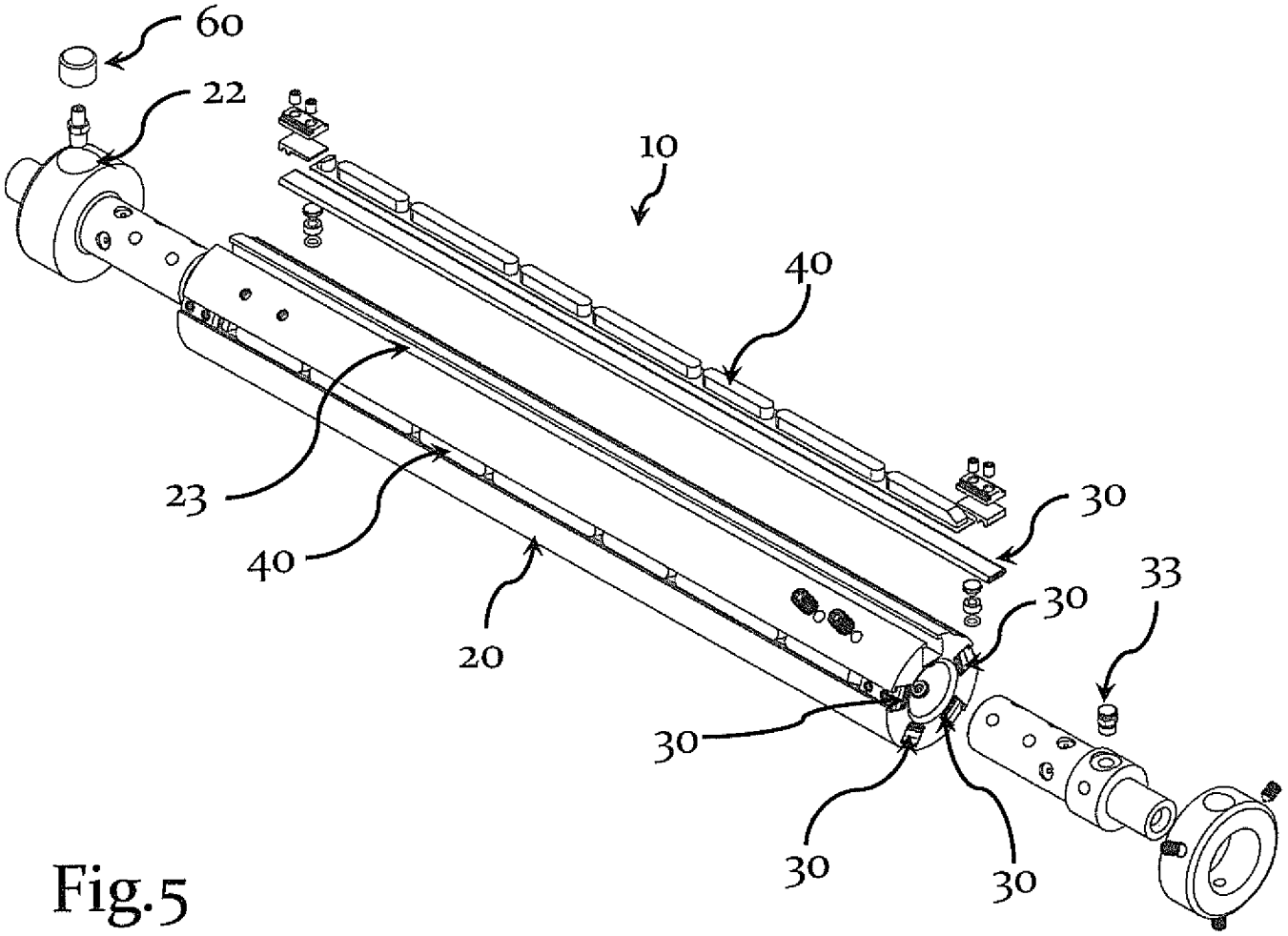
FIG. 5 is a view, partially exploded, of a pneumatic core shaft with multiple bladders.
Figure 6:
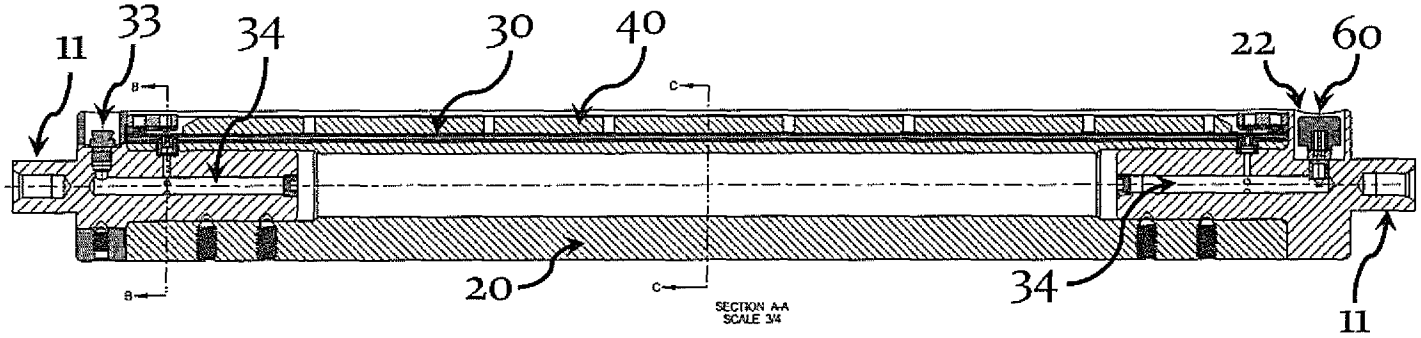
FIG. 6 is a cross-sectional view of the multiple bladder pneumatic core shaft along the shaft longitudinal axis.
Figure 8:
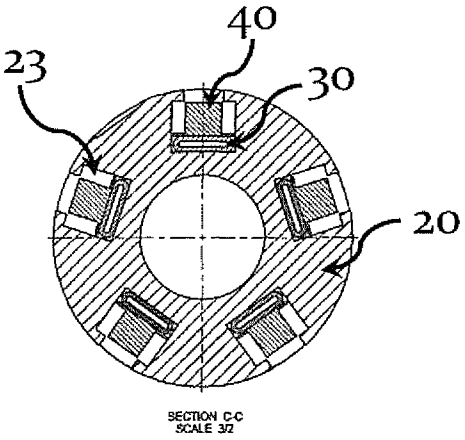
FIG. 8 is a radial axis view of the shaft of FIG. 6 along the line C-C.
Figure 7:
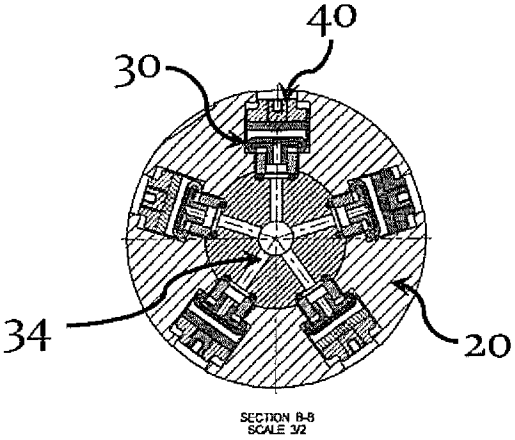
FIG. 7 is a radial axis view of the shaft of FIG. 6 along the line B-B.
Figure 9A:
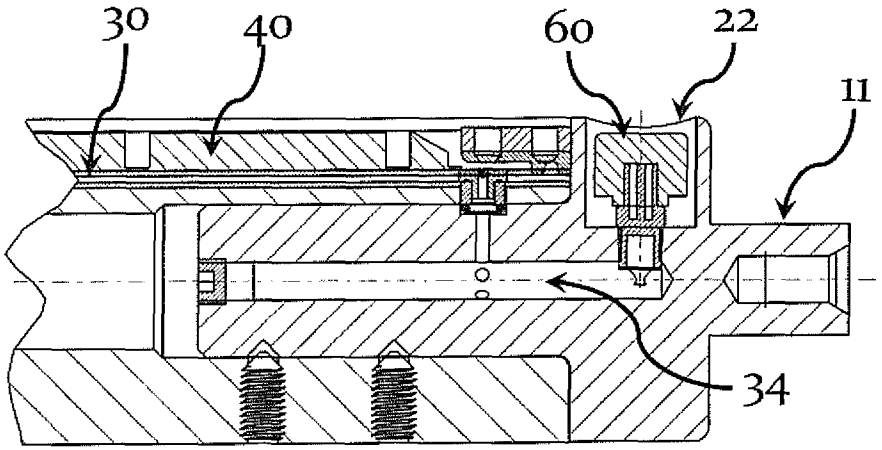
FIG. 9A is a close up view of the right section of the shaft shown in FIG. 6.
Figure 9B:
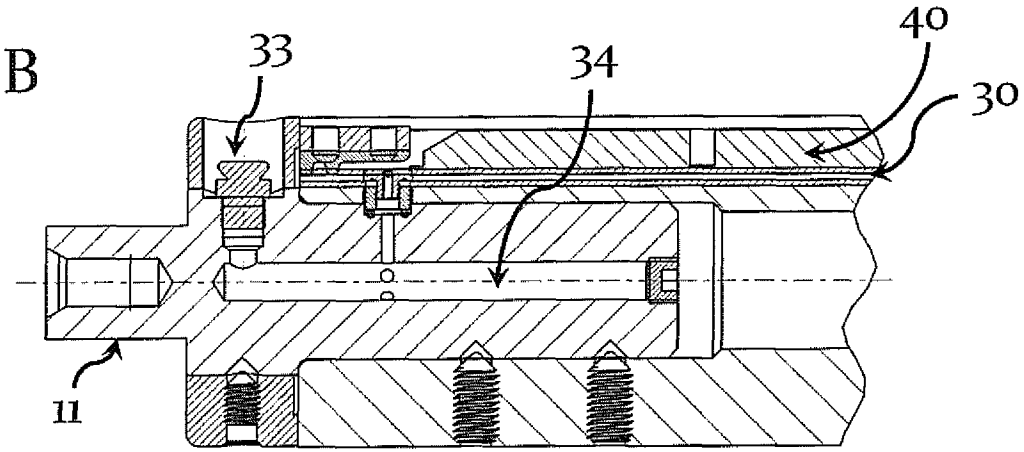
FIG. 9B is a close up view of the left section of the shaft shown in FIG. 6.

Referring more particularly to FIGS. 5-9, 10-11 and 18, there is shown a pneumatic core shaft 10 with multiple air bladders 30 contained within a cylindrical bearing tube 20. An air manifold 34 is provided near to both shaft ends 11 for distributing air to the air bladders 30. The air manifold 34 has a pneumatic inflation valve 33 near a core shaft end 11 for inserting or releasing air into the bladders. The air bladders 30 are positioned within longitudinal channels 23 formed within the bearing tube outer surface. Strip lugs 40 are loosely attached to the bearing tube channels 23 above the air bladders 30. Inflation of the bladders through the inflation valve 33 expands the bladders and forces the strip lugs radially outward for enhanced gripping of a web core. The strip lug 40 can either be in the shown configuration, or as a leaf-type lug (not shown). The shaft bearing tube 20 has a sensor aperture 22 formed therein providing an opening to an air manifold 34. A sensor assembly 60 is seated within the bearing tube sensor aperture 22 and joined in operative engagement with an air manifold interior 34. The sensor assembly 60 is generally positioned at a shaft end 11 opposite to the inflation valve 33, but could also be positioned on the same shaft end as the inflation valve 33. Operation of the sensor assembly 60 is as described above.

Figure 12:
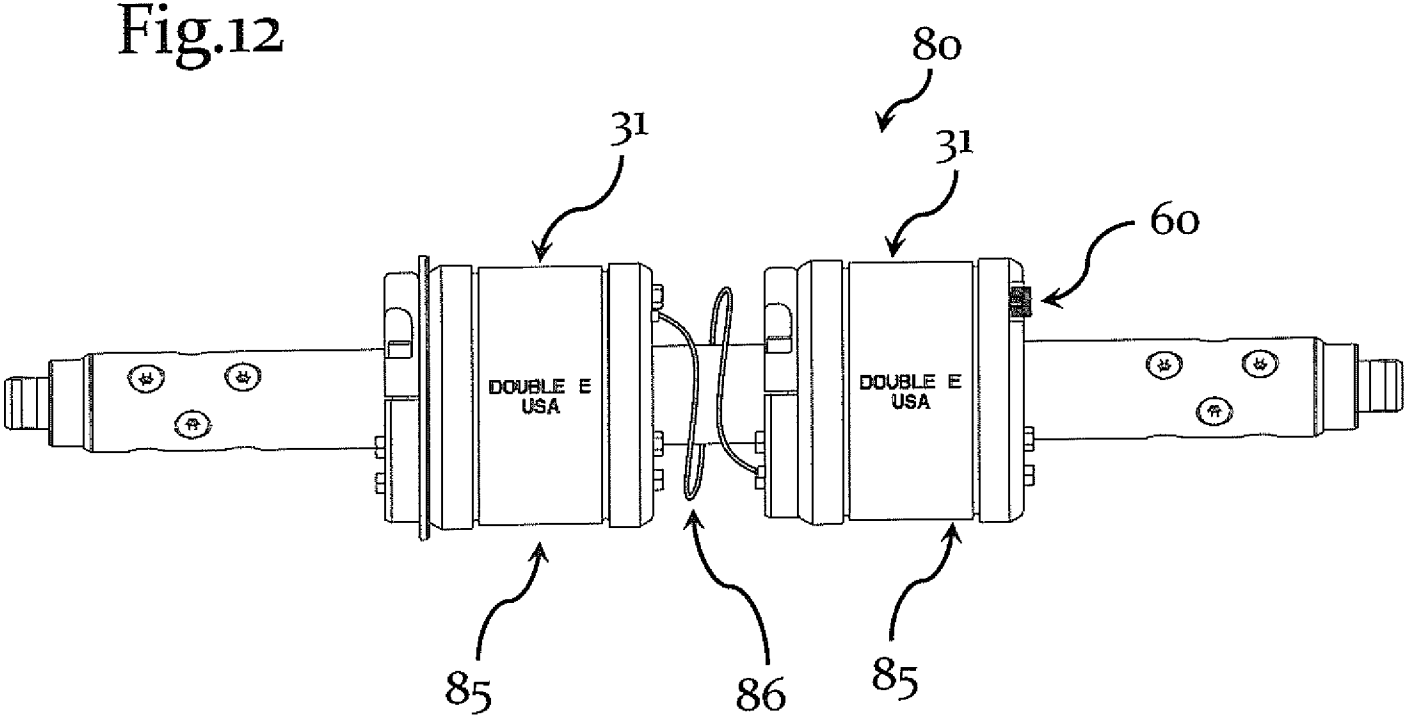
FIG. 12 is a plan view of an external bladder shaft adapter.
Figure 13:
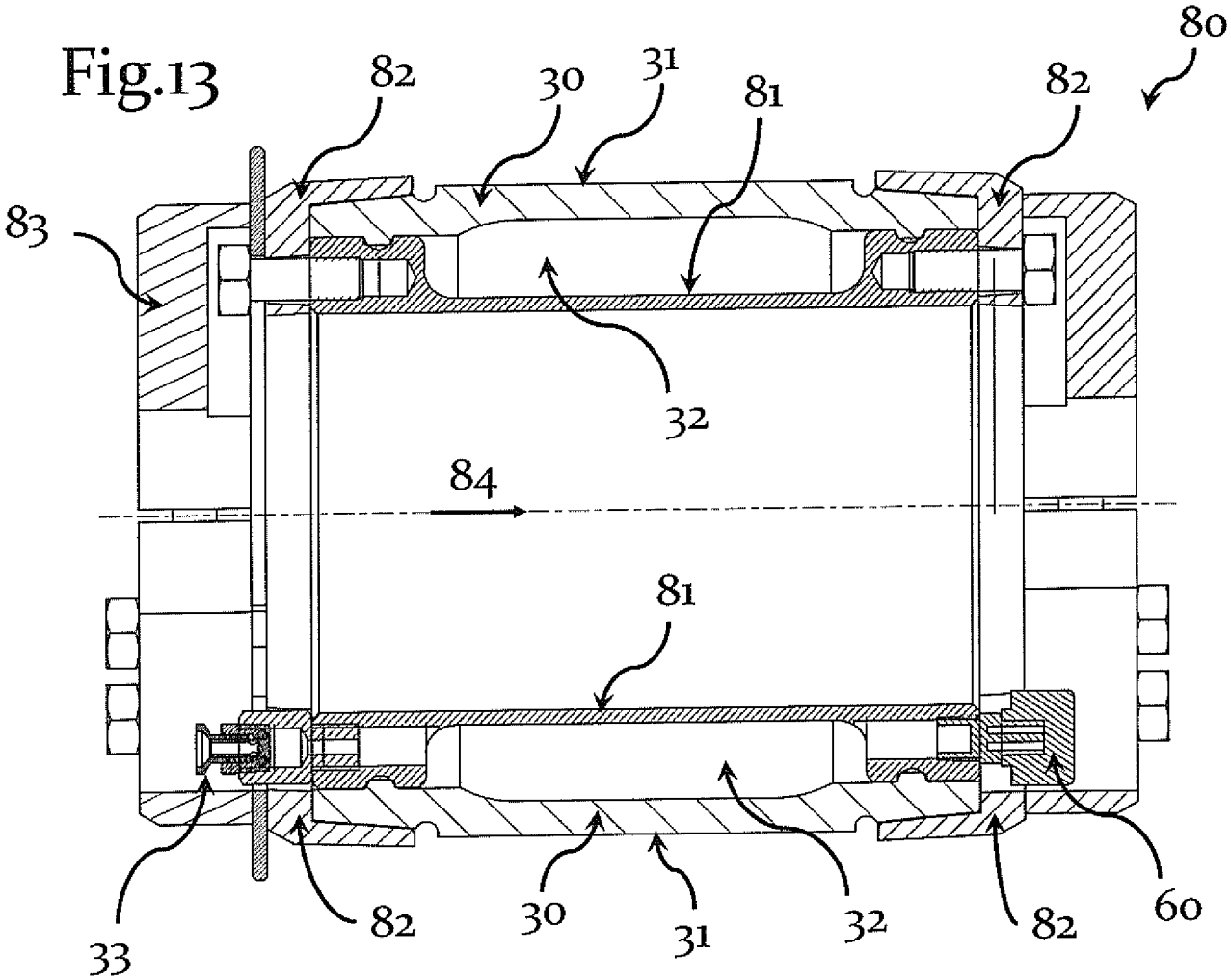
FIG. 13 is a diagrammic cross-sectional view, partly in section, of the external bladder shaft adapter of FIG. 12.

Referring more particularly to FIGS. 10-11, 12, 13 and 18, there is shown an external bladder type shaft adapter 80. This type of shaft adapter is generally mounted onto a steel bar or as a shaft adapter so a 3" shaft can grip a 6" or larger core. The principles of the invention are the same whether or not the pneumatic air bladder is with a core shaft or shaft adapter. The advantages of monitoring attributes of the bladder, such as air pressure, temperature and motion are the same. As shown, the external bladder shaft adapter 80 is comprised of left and right modules 85 each having a hollow bore 84, two end caps 82 and a clamp collar 83 for attachment to a shaft (not shown). Each external bladder adapter module 85 has an air bladder 30 about the adapter module main body 81. The bladder is made from a semi-rigid polyurethane material, or similar, and its exterior surface 31 expands radially about the adapter to make direct contact with a core (not shown). The bladder interior 32 receives air through an inflation valve 33 mounted on one side of the adapter parallel to the adapter longitudinal axis. A sensor assembly 60 is attached to the bladder 30 on the other side of the adapter parallel to the adapter longitudinal axis. The sensor assembly transmits sensed data as described above. The air bladders 30 for the modules may be interconnected by a pneumatic hose 86.

Figure 14:
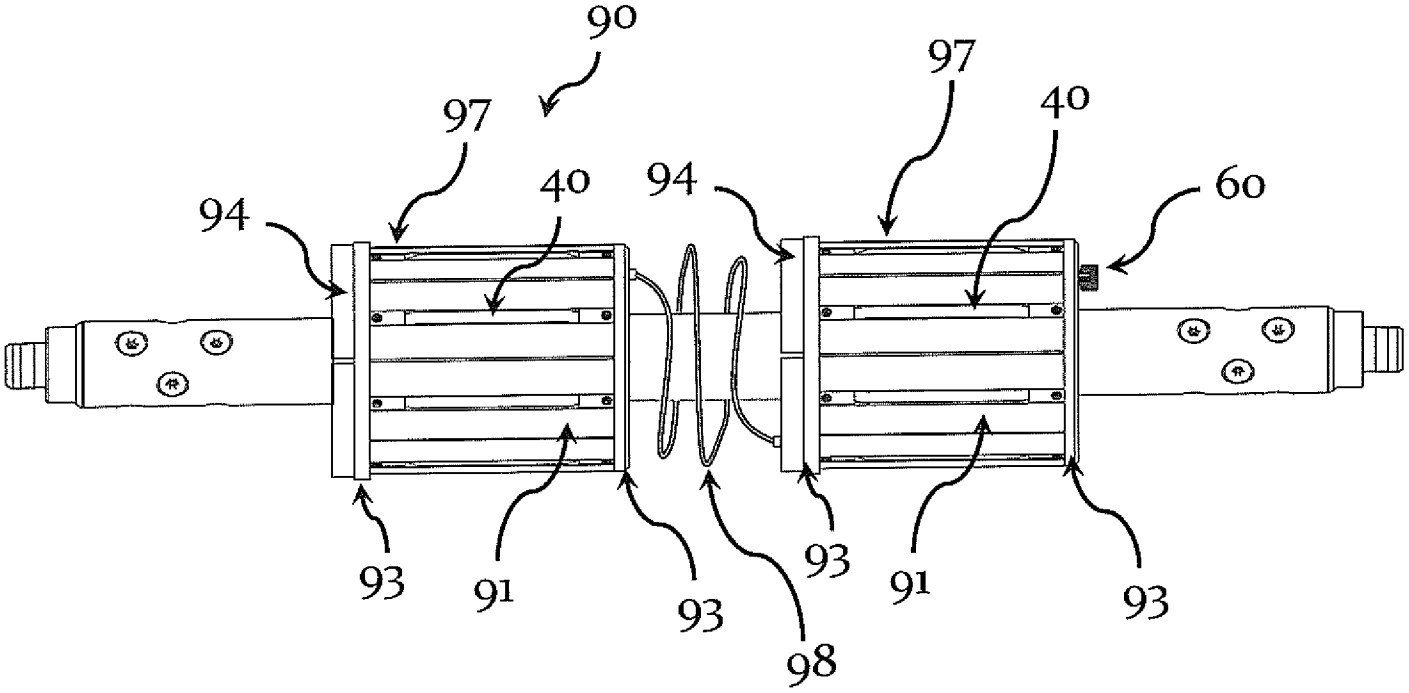
FIG. 14 is a plan view of a strip style shaft adapter.
Figure 15B:
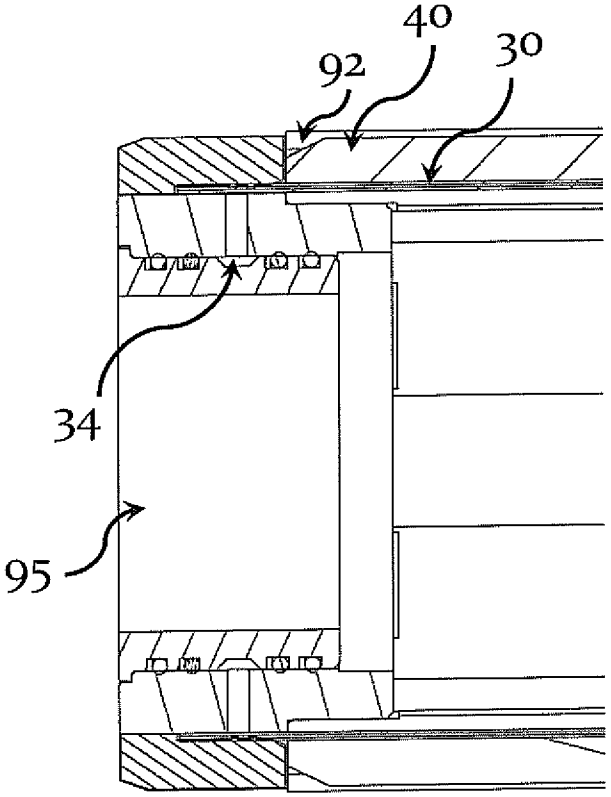
FIG. 15B is another diagrammic cross-sectional view of the sensor end of the adaptor of FIG. 14.
Figure 15A:
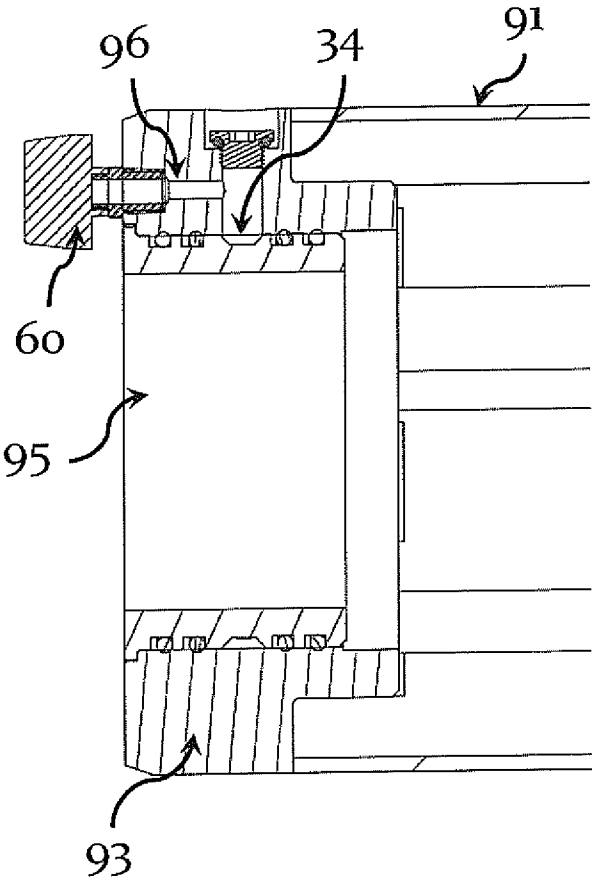
FIG. 15A is a diagrammic cross-sectional view of the sensor end of the adapter of FIG. 14.
Figure 16B:
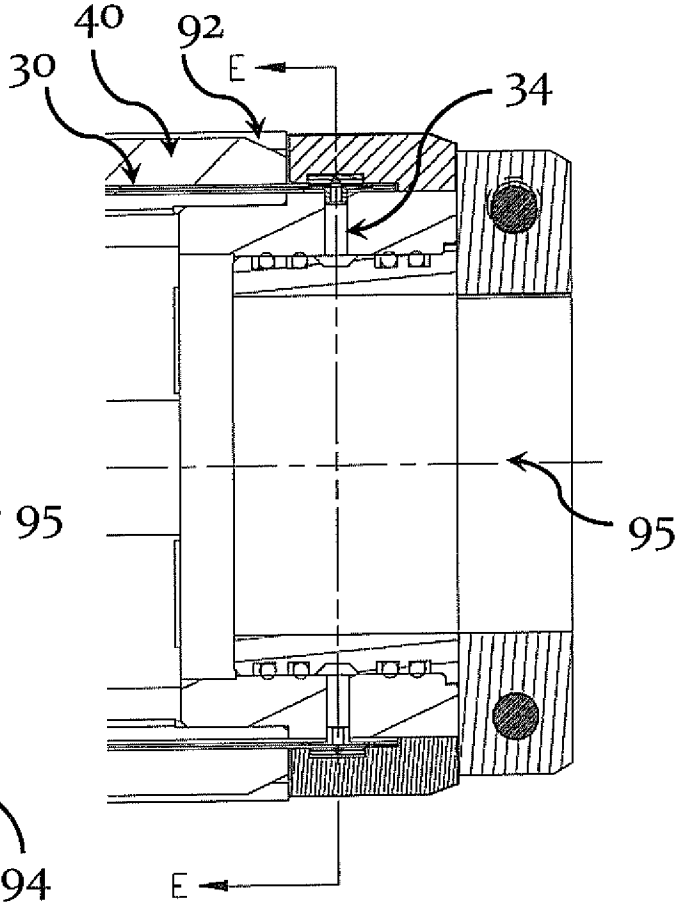
FIG. 16B is another diagrammic cross-sectional view of the non-sensor end of the adapter of FIG. 14
Figure 16A:
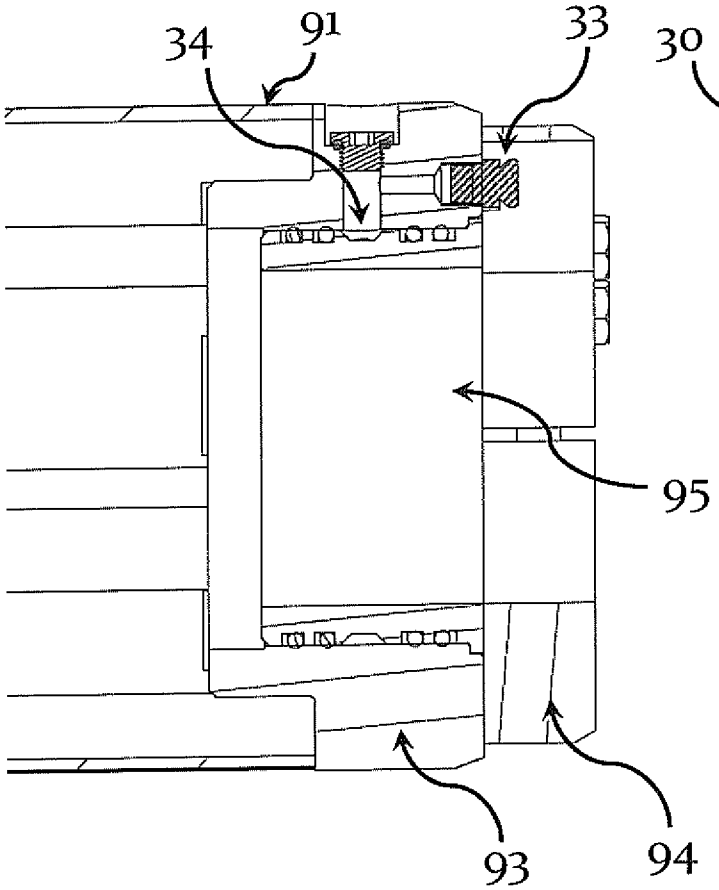
FIG. 16A is a diagrammic cross-sectional view of the non-sensor end of the adapter of FIG. 14.
Figure 17:
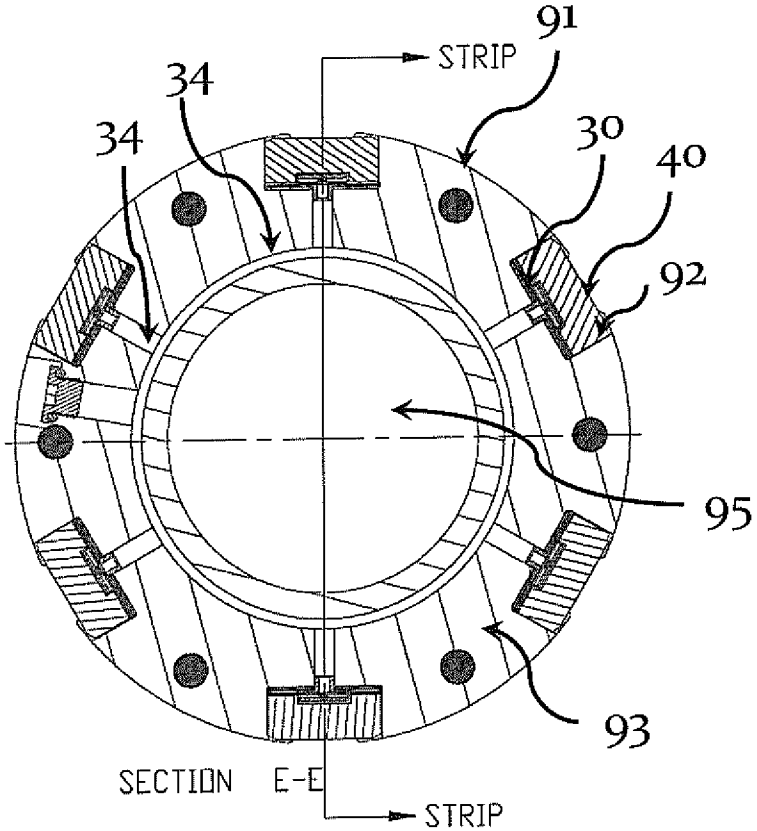
FIG. 17 is a diagrammic end view of the non-sensor end of the adapter of FIG. 14.

Referring more particularly to FIGS. 10, 11, 14-17, and 15, there is shown a strip style shaft adapter 90. As with the bladder adapter, a strip adapter is generally mounted onto a steel bar or as a shaft adapter so a small diameter shaft can grip a larger core. The strip adapter 90 is comprised of a left and right module 97, each comprised of a hollow, generally cylindrical bearing tube 91 with a hollow bore 95 and having a plurality of longitudinal channels 92 formed therein. Each channel has an air bladder 30 driving a corresponding strip lug 40 for engagement with a core (not shown). The air bladders 30 are interconnected by means of an air manifold 34 which in turn is inflated through a pneumatic inflation valve 33. The air manifolds for each module 97 may be interconnected by means of a pneumatic hose 98. The strip adapter have end caps 93 and clamp collars 94 for attachment to a shaft. A sensor assembly 60 is attached to one end of the adapter 90 and is interconnected to the air manifold by means of a pneumatic sensor connection 96. The sensor assembly 60 transmits sensed data as described above.

It is understood that the above-described embodiments are merely illustrative of the application. Other embodiments may be readily devised by those skilled in the art, which will embody the principles of the invention and fail within the spirit and scope thereof.

We claim:

1. A monitoring system for pneumatic core shafts, comprising:
   - a pneumatic core shaft for gripping and holding a core of a wound material roll, comprising:
     - a hollow, cylindrical bearing tube, having a plurality of apertures;
     - an air bladder contained within said bearing tube, said air bladder having an exterior surface and an interior;
     - a pneumatic inflation valve connected to and positioned near a bladder end for inserting and releasing air to and from said bladder interior;
     - a shaft end engaged with a drive coupling means;
     - a sensor aperture formed in said bearing tube and providing an opening to the bladder;
   - a sensor assembly seated within said bearing tube sensor aperture and joined in operative engagement with said bladder interior;
   - wherein said sensor assembly is comprised of a plurality of transducers, a sensor pre-processor, a microprocessor, a wireless transmitter and antenna;
   - an external receiver for receiving data sensed by said transducers and transmitted by said antenna.

2. A system as recited in claim 1, further comprising:

a plurality of lugs loosely held and protruding through said bearing tube apertures, wherein said air bladder exterior surface is adapted to push the lug outwardly through said apertures into engagement with the core of said wound material roll.

3. A system as recited in claim 2, wherein:

said transducers may be comprised of an air pressure sensor, acceleration sensor, temperature sensor, and battery power level sensor.

4. A system as recited in claim 3, further comprising:

a processor connected to said external receiver for stripping said sensed data from a transmitted signal and converting said data to a desired format;

a display connected to said processor for presenting said sensed data.

5. A system as recited in claim 4, wherein said processor and display may provide the following control and monitoring features:

visual/audible/digital signal alarms when air bladder pressure is outside preprogrammed minimum and maximum limits;

visual/audible/digital signal alarms when temperature is outside preprogrammed minimum and maximum limits;

internal logic to determine when a shaft has been inflated;

resettable counter for number of inflations for a specific shaft;

timer to determine total time a shaft has been inflated;

visual/audible/digital signal alarm to indicate a preset inflation value has been reached;

operating lock until a preset inflation has been reached;

visual/audible/digital signal alarm indicating a bladder slow leak;

visual/audible/digital signal alarm output indicating a low battery level for sensors with batteries;

visual/audible/digital indicators when shaft starts and stops rotating;

counter/timer determining number and/or time shaft has been rotating;

visual/audible/digital indicator of shaft RPM; and visual/audible/digital signal alarms when shaft RPM is outside programmed ranges.

6. A system as recited in claim 5, wherein:

said sensor aperture is formed in said bearing tube in an end opposite to said pneumatic inflation valve.

7. A monitoring system for pneumatic core shafts, comprising:

a pneumatic core shaft for gripping and holding a core of a wound material roll, comprising:

a hollow, cylindrical bearing tube, having a plurality of longitudinal channels formed within a bearing tube exterior surface, and two, opposite ends;

a plurality of air bladders contained within said bearing tube, each said air bladder having an exterior surface and an interior, each air bladder positioned within a bearing tube longitudinal channel.

an air manifold near a shaft end interconnected to and distributing air to said air bladder interiors;

a pneumatic inflation valve connected to said air manifold and positioned near a core shaft end for inserting and releasing air into said bladder interiors;

a shaft end engaged with a drive coupling means;

a sensor aperture formed in said bearing tube and providing an opening to said air manifold;

a sensor assembly seated within the bearing tube sensor aperture and joined in operative engagement with an air manifold interior;

wherein said sensor assembly is comprised of a plurality of transducers, a sensor pre-processor, a microprocessor, a wireless transmitter and antenna;

an external receiver for receiving data sensed by said transducers and transmitted by said antenna.

8. A system as recited in claim 7, further comprising:

a strip lug loosely held and attached to each bearing tube longitudinal channel above an air bladder wherein inflation of an air bladder through the inflation valve expands the air bladder forcing the strip lug radially outward for enhanced gripping of said core.

9. A system as recited in claim 8, wherein:

said transducers may be comprised of an air pressure sensor, acceleration sensor, temperature sensor, and battery power sensor.

10. A system as recited in claim 9, further comprising:

a processor connected to said external receiver for stripping said sensed data from a transmitted signal and converting said data to a desired format;

a display connected to said processor for presenting said sensed data.

11. A system as recited in claim 10, wherein said processor and display may provide the following control and monitoring features:

visual/audible/digital signal alarms when air bladder pressure is outside preprogrammed minimum and maximum limits;

visual/audible/digital signal alarms when temperature is outside preprogrammed minimum and maximum limits;

internal logic to determine when a shaft has been inflated;

resettable counter for number of inflations for a specific shaft;

timer to determine total time a shaft has been inflated;

visual/audible/digital signal alarm to indicate a preset inflation value has been reached;

operating lock until a preset inflation has been reached;

visual/audible/digital signal alarm indicating a bladder slow leak;

visual/audible/digital signal alarm output indicating a low battery level for sensors with batteries;

visual/audible/digital indicators when shaft starts and stops rotating;

counter/timer determining number and/or time shaft has been rotating;

visual/audible/digital indicator of shaft RPM; and visual/audible/digital signal alarms when shaft RPM is outside programmed ranges.

12. A system as recited in claim 11, wherein:

said sensor aperture is positioned at a core shaft end opposite to the pneumatic inflation valve.

13. A monitoring system for pneumatic shaft adapters, comprising:

an external bladder shaft adapter for gripping a large core of a wound material roll, comprising:

a left and right module, each module having an adapter module main body with two ends;

a hollow bore within each adapter module main body;

two opposite end caps defining each adapter module main body ends;

a clamp collar attached to one end cap of each module for attachment to a shaft;

an air bladder about each adapter main body, said air bladder having an exterior surface and an interior, said air bladder exterior surface adapted to expand radially about the adapter to make direct contact with a core;

an inflation valve connected to said air bladder for inserting and releasing air from said air bladder interior;

a sensor aperture formed in an end cap providing an opening to the air bladder;

a sensor assembly seated with said end cap sensor aperture and joined in operative engagement with said air bladder interior;

wherein said sensor assembly is comprised of a plurality of transducers, a sensor pre-processor, a microprocessor, a wireless transmitter and antenna;

an external receiver for receiving data sensed by said transducers and transmitted by said antenna.

14. A system as recited in claim 13, wherein:

said transducers may be comprised of an air pressure sensor, acceleration sensor, temperature sensor, and battery power sensor.

15. A system as recited in claim 14, further comprising:

a processor connected to said external receiver for stripping said sensed data from a transmitted signal and converting said data to a desired format;

a display connected to said processor for presenting said sensed data.

16. A system as recited in claim 15, wherein said processor and display may provide the following control and monitoring features:

visual/audible/digital signal alarms when air bladder pressure is outside preprogrammed minimum and maximum limits;

visual/audible/digital signal alarms when temperature is outside preprogrammed minimum and maximum limits;

internal logic to determine when a shaft has been inflated;

resettable counter for number of inflations for a specific shaft;

timer to determine total time a shaft has been inflated;

visual/audible/digital signal alarm to indicate a preset inflation value has been reached;

operating lock until a preset inflation has been reached;

visual/audible/digital signal alarm indicating a bladder slow leak;

visual/audible/digital signal alarm output indicating a low battery level for sensors with batteries;

visual/audible/digital indicators when shaft starts and stops rotating;

counter/timer determining number and/or time shaft has been rotating;

visual/audible/digital indicator of shaft RPM; and visual/audible/digital signal alarms when shaft RPM is outside programmed ranges.

17. A system as recited in claim 16, wherein:

said sensor aperture is formed in an end cap opposite the inflation valve.

18. A monitoring system for pneumatic shaft adapters, comprising:

a strip shaft adapter for gripping a large core of a wound material roll, comprising:

a left and right module, each having a hollow, cylindrical bearing tube, with a plurality of longitudinal channels formed within a bearing tube exterior surface, and two, opposite ends;

two opposite end caps defining said module bearing tube ends;

a clamp collar attached to one end cap of each for attachment to a shaft;

a plurality of air bladders contained within said bearing tube, each said air bladder having an exterior surface and an interior, each air bladder positioned within a bearing tube longitudinal channel.

an air manifold near both bearing tube ends interconnected to and distributing air to said air bladder interiors;

a pneumatic inflation valve connected to said air manifold and positioned near a bearing tube end for inserting and releasing air into said bladder interiors;

a sensor aperture formed in an end cap and providing an opening to said air manifold;

a sensor assembly seated within the bearing tube sensor aperture and joined in operative engagement with an air manifold interior;

wherein said sensor assembly is comprised of a plurality of transducers, a sensor pre-processor, a microprocessor, a wireless transmitter and antenna;

an external receiver for receiving data sensed by said transducers and transmitted by said antenna.

19. A system as recited in claim 18, further comprising:

a strip lug loosely held and attached to each bearing tube longitudinal channel above an air bladder wherein inflation of an air bladder through the inflation valve expands the air bladder forcing the strip lug radially outward for enhanced gripping of said core.

20. A system as recited in claim 19, wherein:

said transducers may be comprised of an air pressure sensor, acceleration sensor, temperature sensor, and battery power sensor.

21. A system as recited in claim 20, further comprising:

a processor connected to said external receiver for stripping said sensed data from a transmitted signal and converting said data to a desired format;

a display connected to said processor for presenting said sensed data.

22. A system as recited in claim 21, wherein said processor and display may provide the following control and monitoring features:

visual/audible/digital signal alarms when air bladder pressure is outside preprogrammed minimum and maximum limits;

visual/audible/digital signal alarms when temperature is outside preprogrammed minimum and maximum limits;

internal logic to determine when a shaft has been inflated;

resettable counter for number of inflations for a specific shaft;

timer to determine total time a shaft has been inflated;

visual/audible/digital signal alarm to indicate a preset inflation value has been reached;

operating lock until a preset inflation has been reached;

visual/audible/digital signal alarm indicating a bladder slow leak;

visual/audible/digital signal alarm output indicating a low battery level for sensors with batteries;

visual/audible/digital indicators when shaft starts and stops rotating;

counter/timer determining number and/or time shaft has been rotating;

visual/audible/digital indicator of shaft RPM; and visual/audible/digital signal alarms when shaft RPM is outside programmed ranges.

23. A system as recited in claim 22, wherein:

said sensor aperture is formed in an end cap opposite the inflation valve.

* * * * *